US005969700A

United States Patent [19]

Fitzgibbons et al.

[11] Patent Number: 5,969,700

[45] Date of Patent: Oct. 19, 1999

[54] METHOD OF IMPROVING VIEWING ANGLE AND CONTRAST OF LIQUID CRYSTAL DISPLAYS

[75] Inventors: Thomas J. Fitzgibbons, Sunrise; Patrick M. Dunn, Coral Springs, both of Fla.

[73] Assignee: Motorola, Inc., Schaumburg, Ill.

[21] Appl. No.: 08/888,796

[22] Filed: Jul. 7, 1997

[51] Int. Cl.[6] ..... G09G 3/36

[52] U.S. Cl. ..... 345/87; 349/117

[58] Field of Search ..... 345/87; 349/33, 349/34, 35, 36, 37

[56] References Cited

U.S. PATENT DOCUMENTS

| | | | |
|---|---|---|---|
| 3,909,930 | 10/1975 | Gurtler | 29/592 |
| 5,109,219 | 4/1992 | Kastan et al. | 345/94 |
| 5,124,818 | 6/1992 | Corner et al. | 349/75 |
| 5,175,637 | 10/1992 | Jones et al. | 349/1 |
| 5,307,188 | 4/1994 | Dingwall et al. | 349/41 |
| 5,519,523 | 5/1996 | Madakoro et al. | 349/117 |
| 5,596,349 | 1/1997 | Kobayashi | 345/147 |

*Primary Examiner*—Steven J. Saras
*Assistant Examiner*—Fritz Alphonse
*Attorney, Agent, or Firm*—Dale W. Dorinski

[57] ABSTRACT

A novel method of driving an LCD simultaneously provides improved viewing angle and improved contrast. Multiple driving voltages are applied to the LC cell to optimize both the viewing angle and the contrast. A first voltage that is optimized for wide viewing angle is applied to the LCD. A second voltage that is greater than the first voltage is selected to provide maximum contrast in the LCD. The first and second voltages are alternately applied to In the LCD, resulting in a display that has high contrast and a wide viewing angle.

10 Claims, 4 Drawing Sheets

METHOD OF IMPROVING VIEWING ANGLE AND CONTRAST OF LIQUID CRYSTAL DISPLAYS

TECHNICAL FIELD

This invention relates to liquid crystal displays in general, and more particularly to a method of driving the cell in a display.

BACKGROUND

Liquid crystal display (LCD) in general, and twisted-nematic (TN) LCDs in particular, exhibit a strong effect of viewing direction on their optical properties. FIG. 1 shows two light rays traveling through an LCD cell 10 at normal 11 and oblique 12 directions. Since the properties of the linear polarizers on the exterior of the cell and the length of the optical path through the LCD both change with incidence angle, the light intensity and the contrast of the LCD are strongly affected by the direction under which the observer views the display. Thus, the traditional problem of narrow viewing angle arises.

Some have attempted to solve this problem by increasing the contrast of the LCD. This has been done by adjusting the driving voltage to the liquid crystal (LC) cell. Typical TN LCDs are driven with AC-voltage using square wave signals of constant amplitude. When the display is driven with standard multiplexing signals the modulations in the liquid crystal fluid become pronounced. Stimulated by the selected pulse, the optical axis of the liquid crystal rotates towards the direction of the electrical field at the beginning of the frame period and it relaxes toward the initial state during the rest of the frame. This modulation of transmitted or reflected light is called the frame response. Though the human eye averages these modulations if their depth and frequency are within certain limits, frame response severely reduces the contrast of highly multiplexed LCDs by brightening up the 'dark' state of positive contrast LCDs. Increasing the driving voltage improves the contrast of the LCD, but decrease the effective viewing angle.

In the ideal situation, the display of an LCD would appear the same no matter what the position of the observer is relative to the LCD. This concept of appearance over a wide range of positions is known as the 'viewing cone'. FIG. 2 shows a schematic representation of the ideal viewing cone, where an LCD 20 situated in the center of the cone 22 appears the same to an observer 24 positioned anywhere on the hemisphere. Practical considerations such as those enumerated above severely distort the viewing cone so that it is often very narrow. Present day LCDs are designed to have various shaped viewing cones, depending on the location of the display relative to the user. Increasing the contrast ratio, as described above, results in narrowing the viewing cone. Thus, traditional attempts to improve one of these properties have degraded the other. It would be desirable if one could create an LCD that has high contrast and a wide viewing cone.

DETAILED DESCRIPTION OF THE PREFERRED EMBODIMENT

Figure 1:
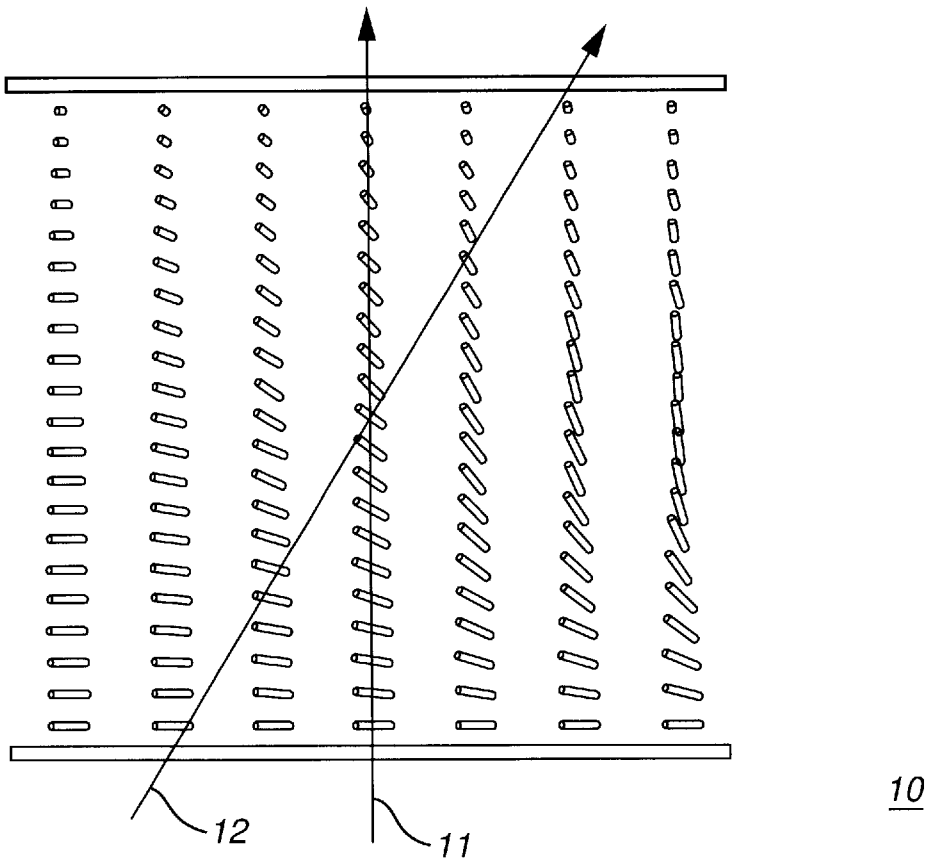
FIG. 1 (PRIOR ART)
FIG. 1 is a schematic representation of a cross section of a typical prior art liquid crystal display.
Figure 2:
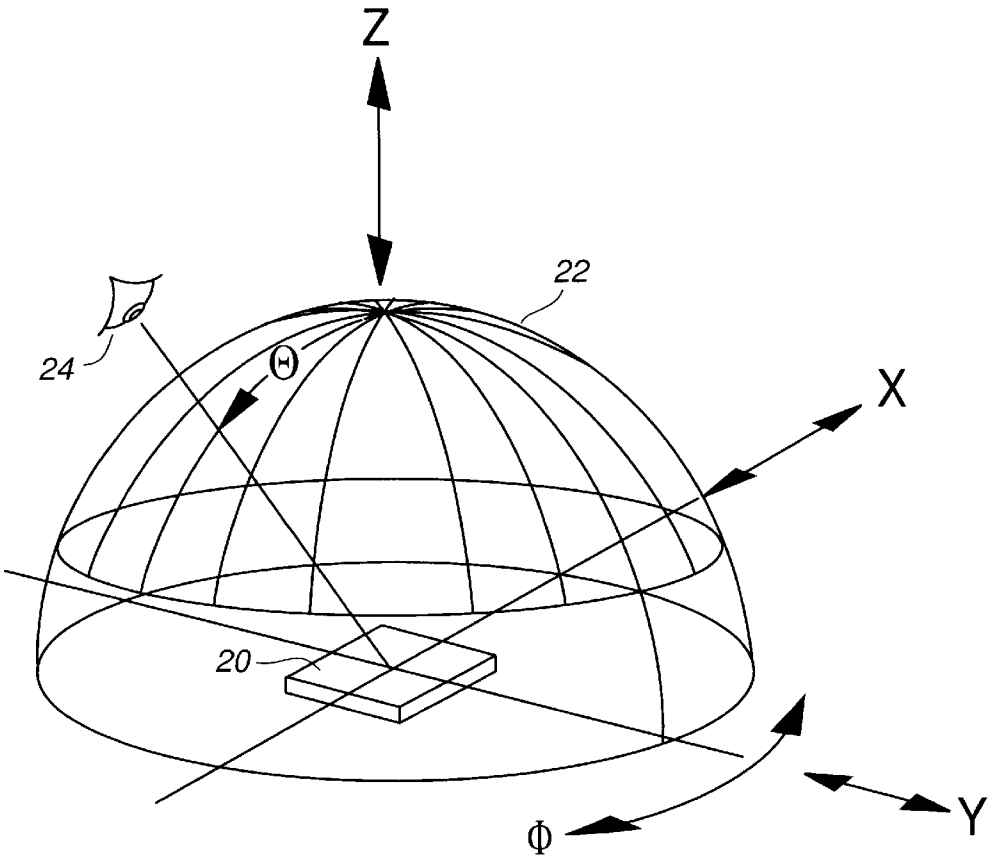
FIG. 2 is a schematic representation of the viewing cone for an ideal liquid crystal display.

A novel method of driving an LCD simultaneously provides improved viewing angle and improved contrast. Multiple driving voltages are applied to the LC cell to optimize both the viewing angle and the contrast. A first voltage that is optimized for wide viewing angle is applied to the LCD. Then, a second voltage that is greater than the first voltage is selected to provide maximum contrast in the LCD. The first and second voltages are alternately applied to the LCD, resulting in a display that has high contrast and a wide viewing angle.

The display driver is an interface circuit that responds to a command and delivers a voltage to the rows or column lines in a display panel. The driver works on command from another circuit, called a controller. The controller is a microprocessor that performs the function of gathering information from the host system and sending it to the driver for writing to the LCD. A major function of the driver circuit is to deliver a high voltage from a power supply to the rows or columns. The logic section of the driver usually operates at a low voltage level, while the switching section operates at higher voltages. Drivers consist of integrated shift registers, level shifters, and drivers. A shift register receives the data from a single input line and transfers it to the latch circuit. The latches hold the data until they receive the signal to transfer them to the driver circuits. The shift register is a memory that accepts the data, holds it until it is all loaded, and then dumps it. The level shifter is a device that raises the voltage of the output to the required level. Multiplexing requires that up to four different voltage levels be used, and the level shifter provides those voltages. The driver is the output device that connects to the row or column line in the LCD.

Contrast ratio is generally considered to be one of the most important visual characteristics of a display. The sole function of a display is to convey information by modifying an array of dots on a screen. The contrast ratio indicates the amount of difference that can be used to discriminate between a pixel that is fully on and one that is off. The formula for the contrast ratio (CR) is $$\text{Contrast Ratio} = \frac{\text{Luminance of 'ON' pixel}}{\text{Luminance of 'OFF' pixel}}$$

For reference, a good photocopy may have a CR of about 20 and a newspaper is about 10. However, the human eye cannot distinguish the differences once the CR is above about 10:1.

Since LCDs do not emit light, the "luminance" shown in the above equation for CR refers to the luminance of light either passing through the display (for a backlit transmissive type) or the luminance of the light reflected off the display's surface (for a reflective type LCD). In multiplexed LCDs, the viewing angle affects the contrast ratio. The CR number of a particular display is often the maximum number obtained at an angle that is not always compatible with actual usage (typically normal to the LCD). A polar chart (isocontrast chart) of the CR versus the solid angle describes the "viewing cone" and is normally provided with a multiplexed LCD. This chart displays the variations in luminance and contrast with viewing direction. Lines of equal contrast ratio are plotted where every point corresponds to a certain viewing direction which is described by a polar coordinate theta and an azimuth angle phi. The visual contrast between the on and off states of LCDs and the variation with viewing angle are important characteristics, because they refer to the weak spot of most electro-optical effects in LCDs.

Having now described our invention and the problems it solves in general terms, one example of a preferred embodiment will now be described in detail. A twisted-nematic liquid crystal display cell was selected at random, and connected to a variable voltage supply. The LCD cell was placed in an apparatus that measures contrast and viewing angle. The threshold voltage was then measured at a viewing angle normal to the plane of the LCD surface. In this example, it was 3.33 volts. The viewing angle was then varied to 45° from normal, and the threshold voltage measured and found to be 3.0 volts. A drive circuit was then constructed that could drive the LCD cell alternately at both voltages, i.e. first at 3.33 volts, then at 3.0 volts, then at 3.33 volts and so on. The first selected voltage (e.g. the low voltage) was applied to all the common lines of the LCD for the duration of a single frame. A pulse of the desired voltage is sequentially applied to each common line, until all common lines have been pulsed at that voltage (i.e., one frame). This results in the LCD having an optical characteristic that is a function of the voltage applied. In this example, during this frame, the LCD has a wide viewing angle. Then, for the second frame, the other selected voltage value (e.g. the higher voltage value) is applied to all the common lines of the LCD for the duration of that single frame. This second voltage value pulse is sequentially applied to each common line, until all common lines have been pulsed at that voltage (i.e., one frame). This results in the LCD having a different optical characteristic than in the previous frame. In this example, the LCD has high contrast; Then, the cycle is repeated, alternating between the two voltages every frame so that the LCD has optimum viewing angle in one frame and optimum contrast in the next frame. Those skilled in the art will appreciate that the speed at which the commons are pulsed is known as the frame rate.

Figure 4:
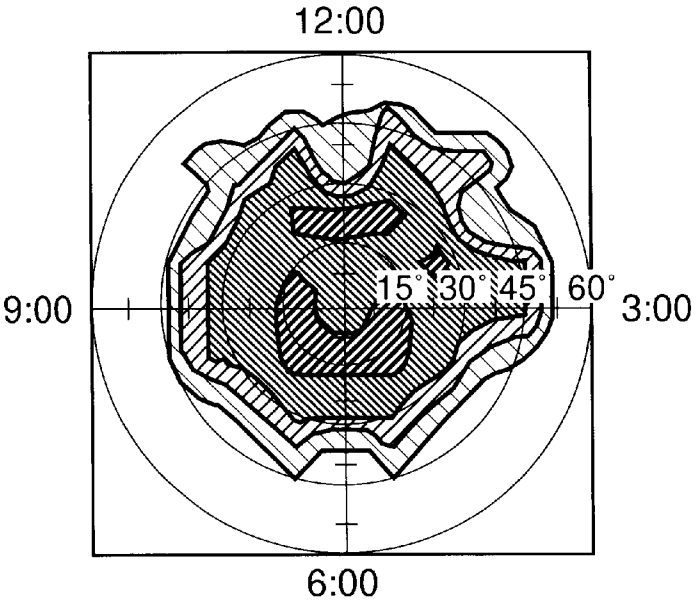
FIGS. 3–5 are isocontrast plots of an LCD driven with a single voltage.
Figure 3:
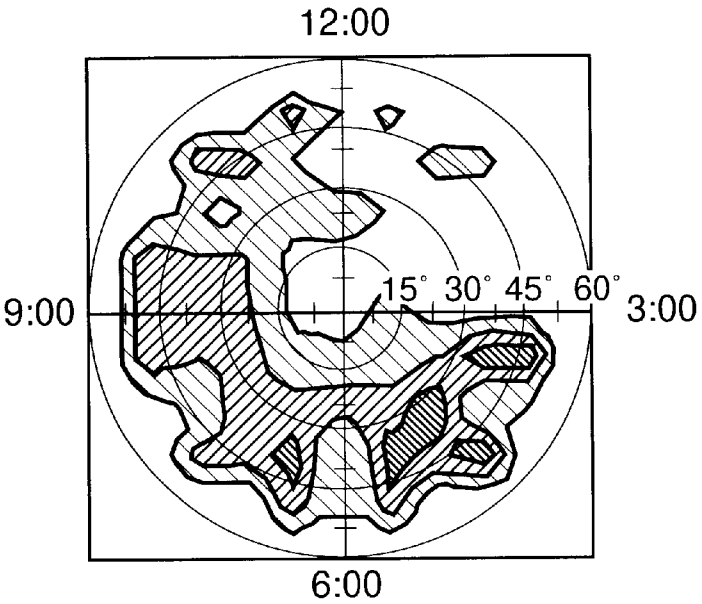
Figure 6:
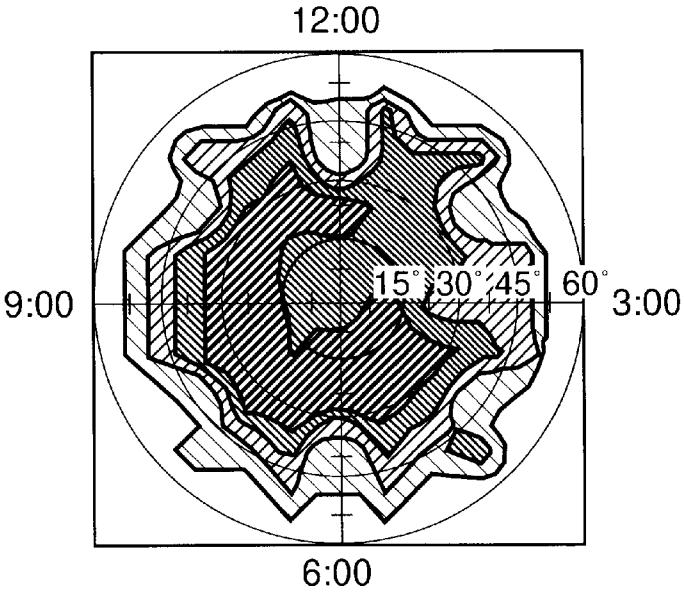
FIG. 6 is an isocontrast plot of an LCD driven in accordance with the invention.
Figure 5:
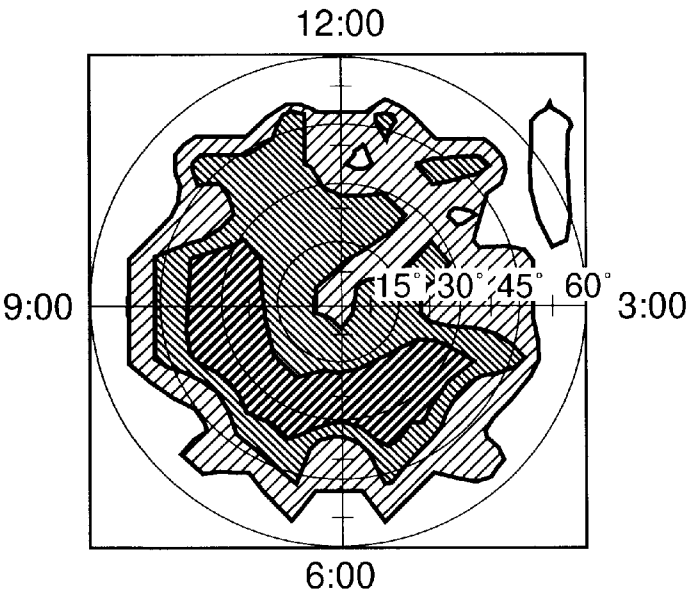

The resulting display visually appeared to have better contrast at a variety of viewing angles than when the same display was driven with a conventional driver at a single voltage. Isocontrast plots for the LCD cell at various driving voltage situations were obtained in order to quantify the results. In FIGS. 3–6, darker shading or hatching represents higher contrast, and one skilled in the art will appreciate that the larger the shaded or hatched area, the wider the viewing angle, as isocontrast plots are a commonly utilized measuring tool in the LCD industry. FIG. 3 shows the isocontrast plot realized when the LCD is driven at a single voltage optimized to provide best viewing angle (3.0 volts). Note that it exhibits good contrast at wide viewing angles. FIG. 4 shows an isocontrast plot of the LCD driven at it's 'correct' voltage dictated by conventional wisdom (i.e. 3.33 volts). Note that the contrast is best at the center, but not at wide viewing angles. FIG. 5 shows the LCD driven at a single voltage that is the average value for the 'correct' voltage and the voltage for optimum viewing angle (i.e. 3.16 volts). Note that it has an overall wider viewing cone than FIG. 4, but at a lower contrast. In contrast to all of the above, the LCD driven by alternating the voltages as in our invention is shown in FIG. 6. This shows a viewing cone that is wider than either FIG. 4 or 5, and has improved contrast at most angles. In this example, the frame rate was 78 Hz, and the rate of voltage alternation was 39 Hz. We believe that frame rates between 60 Hz and 1000 Hz are practical and preferred, and that the voltage should be alternated no more than on time per frame. For certain specialized applications, one may choose to alternate the voltage as fast as 1,000,000 Hz or as slow as once every minute. Clearly, alternating at rates below about 60 Hz would introduce a visible 'flicker' in the display, but certain conditions may warrant such a result, for example, one may choose to alternate the voltage once every second so that the display would alternately have high contrast/narrow viewing angle and then have low contrast/wide viewing angle as perceived by the viewer. These alternate rates are certainly within the scope of our invention. One skilled in the art will appreciate the best results are obtained if the rate of alternating is synchronized with an integer multiple of the frame rate of the LCD. Optionally, the rate of alternating can be synchronized to the beginning of the frame. Best results are also obtained when the rate of alternating between voltages is less than the response time of the LCD. In most situations this is typically greater than 30 Hz.

In summary, a method of driving an LCD has been created that results in high contrast and wide viewing angle, heretofore unseen in prior art displays. This method eliminates the compromise required when driving conventionally, although it requires an additional circuit to alternate the voltages. The circuit can be incorporated either in the driver, between the driver and the LCD, or upstream of the driver. While the preferred embodiments of the invention have been illustrated and described, it will be clear that the invention is not so limited, and other equivalents will occur to those skilled in the art without departing from the spirit and scope of the present invention as defined by the appended claims.

What is claimed is:

1. A method of driving an LCD to simultaneously provide improved viewing angle and improved contrast, comprising:

applying a first voltage optimized for wide angle viewing to the LCD;

applying a second voltage optimized for maximum contrast to the LCD, the second voltage being greater than the first voltage; and alternating between the first and second voltages.

2. The method as described in claim 1, wherein the LCD is a twisted nematic.

3. The method as described in claim 1, wherein the step of alternating is performed in a display driver.

4. The method as described in claim 1, wherein the step of alternating is performed upstream of a display driver.

5. The method as described in claim 1, wherein the step of alternating is synchronized with an integer multiple of a frame rate of the LCD.

6. The method as described in claim 5, wherein the step of alternating is synchronized to the beginning of the frame.

7. The method as described in claim 1, wherein the step of alternating is performed at a rate less than the response time of the LCD.

8. The method as described in claim 1, wherein the first and second voltages are alternated at a rate greater than 30 Hz.

9. The method as described in claim 1, wherein the step of alternating is performed at a rate between 1 Hz and 1,000,000 Hz.

10. The method as described in claim 1, wherein the step of alternating is performed at a rate that is perceivable to a human eye.

* * * * *